US009488422B2

(12) United States Patent
Hammer et al.

(10) Patent No.: US 9,488,422 B2
(45) Date of Patent: Nov. 8, 2016

(54) GRENADE AND GRENADE LAUNCHING APPARATUS

(75) Inventors: Helmut Hammer, Heroldsberg (DE); Axel Pfersmann, Feucht (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 115 days.

(21) Appl. No.: 12/976,434

(22) Filed: Dec. 22, 2010

(65) Prior Publication Data

US 2011/0162247 A1 Jul. 7, 2011

(30) Foreign Application Priority Data

Dec. 22, 2009 (DE) ..... 10 2009 060 658

(51) Int. Cl.

| | |
|---|---|
| ***F42B 15/00*** | (2006.01) |
| ***F41A 1/08*** | (2006.01) |
| ***F42B 30/10*** | (2006.01) |
| ***F42B 5/10*** | (2006.01) |
| ***F42B 15/04*** | (2006.01) |

(Continued)

(52) U.S. Cl.

CPC . *F41A 1/08* (2013.01); *F42B 5/10* (2013.01); *F42B 10/06* (2013.01); *F42B 15/04* (2013.01); *F42B 30/10* (2013.01); *F42C 19/0826* (2013.01)

(58) Field of Classification Search

CPC ..... F41A 1/08; F42B 30/10; F42B 5/10; F42B 15/04; F42B 10/06; F42C 19/0826

USPC ..... 102/372

See application file for complete search history.

(56) References Cited

U.S. PATENT DOCUMENTS

| | | | | |
|---|---|---|---|---|
| 982,402 A * | 1/1911 | Wells | ..... | F42B 10/30 102/518 |
| 2,383,053 A * | 8/1945 | Fanger | ..... | F42B 10/06 102/372 |
| 2,426,239 A * | 8/1947 | Renner | ..... | 102/376 |

(Continued)

FOREIGN PATENT DOCUMENTS

| | | |
|---|---|---|
| BE | 465985 A | 7/1946 |
| DE | 1 190 842 | 4/1965 |

(Continued)

OTHER PUBLICATIONS

Anonymous: "Thread 15cm Wirfgrate 41 spreng Nebelwerfer", WK2ammo.com, Sep. 18, 2004, XP002721979.

*Primary Examiner* — Michelle R Clement

(74) *Attorney, Agent, or Firm* — Laurence A. Greenberg; Werner H. Stemer; Ralph E. Locher

(57) ABSTRACT

The present invention relates to a grenade that can be fired from a barrel, for recoilless firing. The barrel is open at both ends and is without any flow cross-section constrictions. The grenade is formed of a grenade base body which surrounds at least one explosive charge, and a flow cross-section reduction device for reducing the flow cross-section of the barrel. The device is arranged in the opposite direction to the firing direction X with respect to the grenade base body. The flow cross-section reduction device is connected to the grenade base body, separated from it, via a connecting device, and is connected to it such that it is stable during firing. A grenade launcher or shell firing apparatus has a grenade such as this, and the grenade firing apparatus has a barrel which is open at both ends and does not have any flow cross-section constrictions.

18 Claims, 3 Drawing Sheets

(51) Int. Cl.
*F42B 10/06* (2006.01)
*F42C 19/08* (2006.01)

(56) References Cited

U.S. PATENT DOCUMENTS 2,671,401 A 3/1954 Abranson
2,694,364 A * 11/1954 Liljegren ..... F42B 30/10 102/373
2,767,657 A * 10/1956 Burke ..... F42B 30/12 102/373
3,008,414 A * 11/1961 Jasse ..... 102/372
3,319,781 A * 5/1967 Simpson ..... B65H 49/02 102/504
3,532,300 A * 10/1970 Voss ..... F42B 10/06 102/373
3,550,501 A 12/1970 Munger et al.
3,788,230 A * 1/1974 Losfeld ..... F42B 10/06 102/260
3,802,345 A * 4/1974 La Costa ..... F42B 5/03 102/522
3,915,091 A * 10/1975 Smith et al. ..... 102/373
4,404,887 A 9/1983 Piesik
4,452,124 A 6/1984 Morenus et al.
4,706,569 A * 11/1987 Wallow ..... F42B 12/625 102/489
4,882,997 A * 11/1989 Baxter et al. ..... 102/503
4,903,607 A * 2/1990 Clark ..... B65H 55/00 102/504
5,031,997 A * 7/1991 Redford ..... G02B 6/4457 244/3.12
5,035,169 A * 7/1991 Chapin ..... G02B 6/4457 102/504
5,052,636 A * 10/1991 Chesler ..... B65H 49/02 102/504
5,078,051 A * 1/1992 Amundson ..... F42C 17/04 102/206
5,080,017 A * 1/1992 Asikainen ..... 102/372
5,107,766 A * 4/1992 Schliesske et al. ..... 102/373
5,503,080 A * 4/1996 Goward et al. ..... 102/293
5,564,649 A 10/1996 von Hoessle et al.
6,272,997 B1 * 8/2001 James et al. ..... 102/293
6,769,364 B2 * 8/2004 Kolodzey et al. ..... 102/527
6,772,693 B2 * 8/2004 Kuru et al. ..... 102/293
6,776,102 B2 * 8/2004 Thiesen et al. ..... 102/527
6,779,463 B2 * 8/2004 Mutascio et al. ..... 102/502
6,869,043 B1 * 3/2005 Carlyle et al. ..... 244/3.28
7,036,434 B1 * 5/2006 Vo et al. ..... 102/522
7,089,866 B2 * 8/2006 Alculumbre et al. ..... 102/523
7,430,825 B2 * 10/2008 Vanek et al. ..... 42/18
7,506,587 B1 * 3/2009 Anderson ..... F42B 10/40 102/473
7,549,376 B1 * 6/2009 Grossman ..... F42B 10/50 102/400
7,823,509 B2 * 11/2010 Dindl et al. ..... 102/438
8,037,798 B2 * 10/2011 Lance ..... F41F 1/00 102/501
8,065,961 B1 * 11/2011 Scarr ..... 102/503
8,205,829 B2 * 6/2012 Bossert ..... F41F 3/07 114/238
8,207,480 B2 * 6/2012 Lance ..... F41F 1/00 102/504
8,664,576 B2 * 3/2014 Hunter ..... F41A 1/02 244/1 R
9,021,960 B1 * 5/2015 Cahayla ..... H02G 3/22 102/469
2003/0000122 A1 * 1/2003 Vanek et al. ..... 42/16
2003/0097952 A1 * 5/2003 Findlay ..... 102/503
2005/0066843 A1 * 3/2005 Flatau et al. ..... 102/503
2005/0183615 A1 * 8/2005 Flatau ..... 102/503
2006/0011056 A1 * 1/2006 Edwards ..... F41A 25/02 89/14.3
2006/0096492 A1 * 5/2006 Flatau et al. ..... 102/502
2007/0079819 A1 * 4/2007 Vanek et al. ..... 124/16
2012/0060715 A1 * 3/2012 Scarr ..... 102/439
2012/0175457 A1 * 7/2012 Hunter ..... F41A 1/02 244/3.22
2013/0319212 A1 * 12/2013 Hunter ..... F41A 1/02 89/1.818

FOREIGN PATENT DOCUMENTS

DE 68907257 T2 12/1993
DE 4414737 C1 1/1996
EP 2226607 A2 9/2010
FR 1362182 A 5/1964

* cited by examiner

GRENADE AND GRENADE LAUNCHING APPARATUS

CROSS-REFERENCE TO RELATED APPLICATION

This application claims the priority, under 35 U.S.C. §119, of German patent application DE 10 2009 060 658.0-15, filed Dec. 22, 2009; the prior application is herewith incorporated by reference in its entirety.

BACKGROUND OF THE INVENTION

Field of the Invention

The invention relates to a grenade that can be fired from a barrel, and to a grenade launching apparatus having such a grenade. A grenade of the generic type can be fired from a launcher barrel, for recoilless firing from a barrel which is open at both ends without any flow cross-section constrictions. The grenade has a grenade base body which surrounds an explosive charge.

One known concept for achieving recoilless firing of a grenade from a grenade firing apparatus, or grenade launcher, is based on the grenade firing apparatus consisting of a barrel which is open at both ends and has no flow cross-section constrictions. Ideally, in this case, not only is the size of the flow cross-sectional area constant over the entire barrel length, but also the shape of the flow cross-sectional area. By way of example, the flow cross-sectional area is in the form of a circular disc with a constant radius over the entire barrel length. This ensures that, when the grenade is fired, no axial forces are transmitted to the barrel. The propellant charge gases of the grenade which is being fired can leave the barrel of the grenade firing apparatus at the rear, without any impediment. The impulse of the grenade as it is accelerated forwards has a magnitude which corresponds precisely to that of the impulse of the propellant charge gases which leave the barrel at the rear. Although this concept has the advantage that this allows a grenade which can be fired from a barrel to be fired without recoil in a simple manner with a grenade firing apparatus of relatively simple design, the concept at the same time has the disadvantage, however, that the gas pressure which is created after the propellant charge has been fired flows very quickly to the rear away through the open barrel end. The propulsion effect on the grenade to be fired is therefore only minor.

SUMMARY OF THE INVENTION

It is accordingly an object of the invention to provide a barrel-fired grenade and an associated grenade firing apparatus which overcome a variety of disadvantages of the heretofore-known devices and methods of this general type and which on the one hand ensures that the grenade is fired without recoil, but on the other hand also at the same time achieves a large propulsion effect on the grenade.

With the foregoing and other objects in view there is provided, in accordance with the invention, a grenade for recoilless firing from a barrel that is open at both ends and does not have any flow cross-section constrictions, the grenade comprising:

a grenade base body containing therein at least one explosive charge;

a flow cross-section reduction device for reducing a flow cross-section of the barrel, said device being disposed rearward of said grenade base body relative to a firing direction; and a connecting device connecting said flow cross-section reduction device to said grenade base body at a spacing distance therefrom and connecting said flow cross-section reduction device to said grenade base body rigidly stable during firing.

The invention is in this case based on the concept that, in principle, a flow cross-section constriction in the firing barrel makes it possible to prevent a gas pressure which is created when the propellant charge burns away from flowing away too quickly, thus in the end making it possible to improve the propulsion effect on the grenade body. However, if the rearward opening of the firing barrel is for this purpose constricted, for example, in the form of a nozzle, then this results not only in the advantageous boosting of the propulsion effect on the grenade body but also in a force which is directed axially to the rear being disadvantageously introduced into the firing apparatus.

A flow cross-section reduction device is therefore provided according to the invention, which is not firmly connected to the firing barrel but is connected to the grenade base body, separated from it, via a connecting device, and is connected to it such that it is stable during firing. This on the one hand ensures that no axial forces are introduced into the grenade firing apparatus when the grenade is fired, while on the other hand the flow cross-section reduction device for reducing the flow cross-section of the barrel, which device is arranged in the opposite direction to the firing direction with respect to the grenade base body, advantageously prevents the gas pressure from flowing away too quickly when the grenade is fired.

The grenade base body preferably has a cylindrical shape whose external diameter corresponds essentially to the internal diameter of the firing barrel. This on the one hand allows the charge volume of the grenade to be maximized, while thus on the other hand optimizing the guidance of the grenade body in the firing barrel.

In this case, it is particularly advantageous for the grenade base body to have sealing means on its envelope surface, which sealing means are suitable for sealing gaps between the envelope surface of the grenade base body and the inner surface of the firing barrel. This makes it possible to prevent propellant charge gases from leaving the firing barrel at the front, past the grenade base body, which would lead to a reduction in the propulsion effect on the grenade.

The flow cross-section reduction device preferably comprises a hollow-cylindrical ring, which is connected via one or more webs to the connection device. This makes it possible to ensure that the flow cross-section reduction device has a lightweight structure, which is nevertheless robust.

The external diameter of the ring in this case preferably corresponds to the external diameter of the cylindrical grenade base body at least over a portion of the height of the hollow cylinder. This improves the guidance of the grenade which can be fired from a barrel, and prevents the grenade from tilting in the firing barrel.

It is also advantageous for the edges of the webs and/or of the ring to be inclined on the side facing the grenade base body. This results in the propellant charge gases flowing onto the webs and/or the ring in an aerodynamically advantageous manner.

It is also advantageous for the walls of the webs and/or of the ring to be shaped such that the cavities between them are in the form of nozzles. This makes it possible to ensure an improved thrust effect on the grenade. A particularly good thrust effect is achieved if the nozzle shape is that of a de Laval nozzle.

The flow cross-section reduction device is preferably in the form of an annular fin structure. This has the advantage that the grenade is stabilized in flight after leaving the barrel.

According to one preferred embodiment of the invention, the connecting device comprises a launch barrel, which extends on an elongation of the cylindrical longitudinal axis of the grenade base body. This launch barrel contains a basic charge. In this case, the basic charge may represent the central part of a firing chain which comprises the relay charge, basic charge and main charge. The launch barrel preferably has radial holes which allow the ignited basic charge to flash over to a main charge which can be arranged in an annular shape around the launch barrel and between the grenade base body and the flow cross-section reduction device. These overflow holes in the launch barrel can be sealed by a brass foil. Once the bursting pressure of the brass foil has been reached, the main charge is ignited by the basic charge combustion gases flowing out of the overflow holes.

According to a further preferred embodiment of the invention, the flow cross-section reduction device is a support for a wire-based data link, which can be unwound while the grenade is being fired and connects the grenade to a fire control computer at least until it leaves the firing barrel or else in the initial flight phase of the grenade after leaving the firing barrel. In this case, the wire which can be unwound for the data link is preferably arranged on the flow cross-section reduction device such that the wire is affected as little as possible by the hot powder gases and particles which are created when the grenade is fired. This advantageously ensures that the wire for the data link is not torn when the grenade is fired. In this case, it is particularly advantageous for the wire to be wound in the form of a coil around the ring in a hollow-cylindrical gap, which is open only in the opposite direction to the firing direction, between the external diameter of the ring and the inner surface of the firing barrel. The wire is therefore particularly well protected against the hot powder gases which are created when the grenade is fired, while at the same time ensuring that the wire can be unwound easily.

Furthermore, the present invention also covers a grenade firing apparatus having a grenade as has been described above. In this case, the grenade firing apparatus has a barrel which is open at both ends without any flow cross-section constrictions.

The barrel of the grenade firing apparatus is preferably closed by a cover at its front and/or rear end before the grenade is fired. This makes it possible to prevent foreign bodies from entering the barrel of the grenade firing apparatus. The rear cover is preferably connected to the grenade via a holding device, which is designed to hold the grenade in a rear position in the barrel before firing. This makes it possible to prevent the grenade from sliding to and fro in the barrel before being fired. This therefore prevents damage to the grenade located in the grenade firing apparatus, in particular while the grenade firing apparatus is being transported.

The rear cover is preferably designed to burst under the influence of the gas pressure which is built up by the main charge of the grenade, in order to open the rear end of the barrel. This makes it possible to ensure that the protective effect of the cover is maintained for as long as possible.

In this case, it is particularly advantageous for the holding device via which the rear cover is connected to the grenade to have a weak point at which the holding device breaks during acceleration of the grenade. This makes it possible to minimize the introduction of axial forces into the grenade firing apparatus when the grenade is fired.

Further advantageous embodiments and improvements of the invention will become evident from the following description of preferred exemplary embodiments of the invention. It should be noted that the invention also covers further embodiments which result from a combination of features which are mentioned separately in the patent claims and/or in the description and the figures.

Other features which are considered as characteristic for the invention are set forth in the appended claims.

Although the invention is illustrated and described herein as embodied in a grenade and grenade firing apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
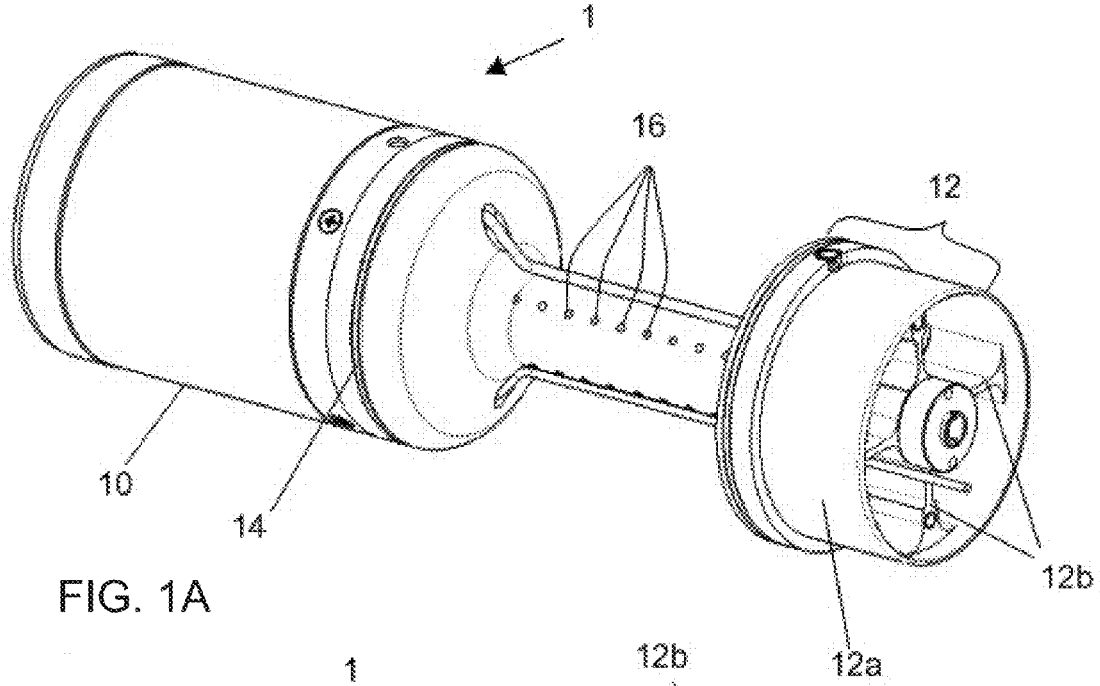
FIGS. 1A and 1B show perspective illustrations of one preferred embodiment of the grenade according to the invention which can be fired from a barrel.

Referring now to the figures of the drawing in detail and first, particularly, to FIGS. 1A and 1B thereof, the subject matter of the invention will now be explained in principle with reference to a barrel-fired grenade 1.

The grenade 1, which may also be referred to as a shell 1, which can be fired from a barrel has a grenade base body 10. The grenade has a flow cross-section reduction device 12 which is arranged in the opposite direction to the firing direction X of the grenade 1, with respect to the grenade base body 10. The flow cross-section reduction device 12 is connected to the grenade base body 10, separated from it, via a connecting device 13, and is connected to it such that it is stable during firing. This grenade 1 can be fired without recoil from a barrel 2 which is open at both ends. The design of the flow cross-section reduction device 12 according to the invention ensures that no axial forces are introduced into the grenade firing apparatus when the grenade 1 is fired. At the same time, this ensures that the flow cross-section of the firing barrel 2 is reduced, thus preventing the gas pressure from flowing away too quickly when the grenade 1 is fired.

The features described in the following text represent advantageous refinements of the principle of the invention as described above.

Figure 1B:
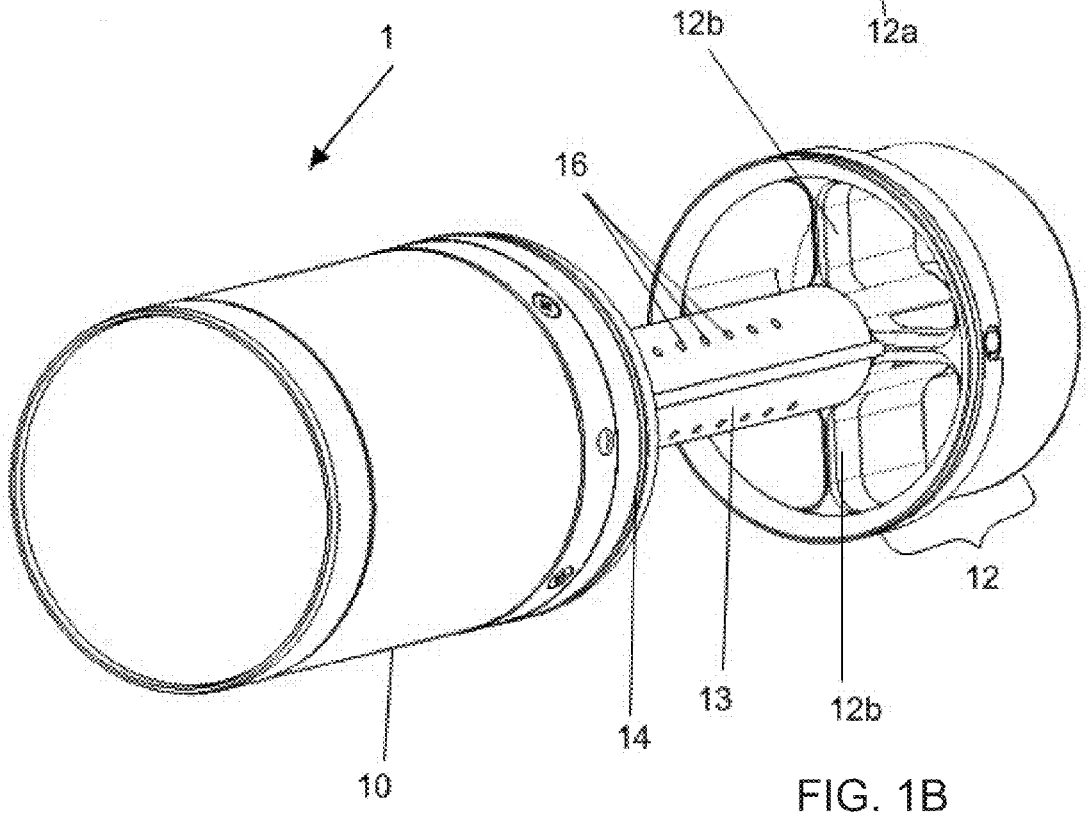

For example, the grenade base body 10 illustrated in FIGS. 1A and 1B has a cylindrical shape. The external diameter of this cylindrical shape preferably corresponds essentially to the internal diameter of the firing barrel 2 from which the grenade 1 is fired. The grenade base body 10 has at least one sealing ring 14 on its envelope surface. These sealing rings make it possible to seal gaps between the envelope surface of the grenade base body 10 and the inner surface of the firing barrel 2. The flow cross-section reduction device 12 comprises a hollow-cylindrical ring 12*a*. The ring 12*a* is connected via one or more webs 12*b* to the connecting device 13. The external diameter of the ring 12*a* corresponds, on the side facing the grenade base body 10, to the external diameter of the cylindrical grenade base body 10. Behind this, the ring 12*a* tapers to a hollow-cylindrical ring with a somewhat smaller radius. The edges of the webs 12*b* and of the ring 12*a* are inclined on the side facing the grenade base body 10. The walls of the webs 12*b* and of the ring 12*a* are shaped such that the cavities between them are in the form of nozzles. The flow cross-section reduction device 12 is in the form of an annular fin structure. The connecting device 13 comprises a barrel which extends on an elongation of the cylindrical longitudinal axis of the grenade base body 10. This barrel 13 contains a basic charge 15. The barrel 13 has radial holes 16 which allow the ignited basic charge 15 to flash over to a main charge 17 which can be arranged in an annular shape around the launch barrel and between the grenade base body 10 and the flow cross-section reduction device 12. This main charge 17 may comprise one or more perforated discs composed of propellant charge material, through which the barrel 13 passes.

Figure 2A:
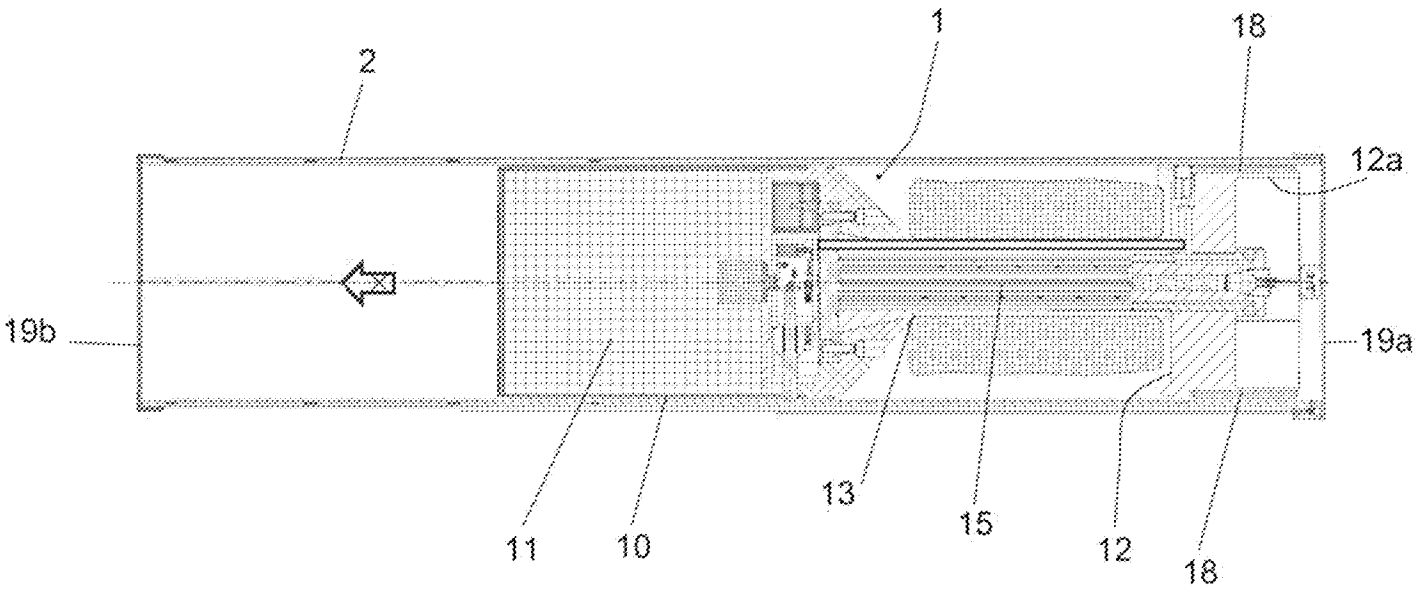
FIG. 2A shows a section drawing through one preferred embodiment of a grenade firing apparatus according to the invention with a grenade according to the invention.
Figure 2B:
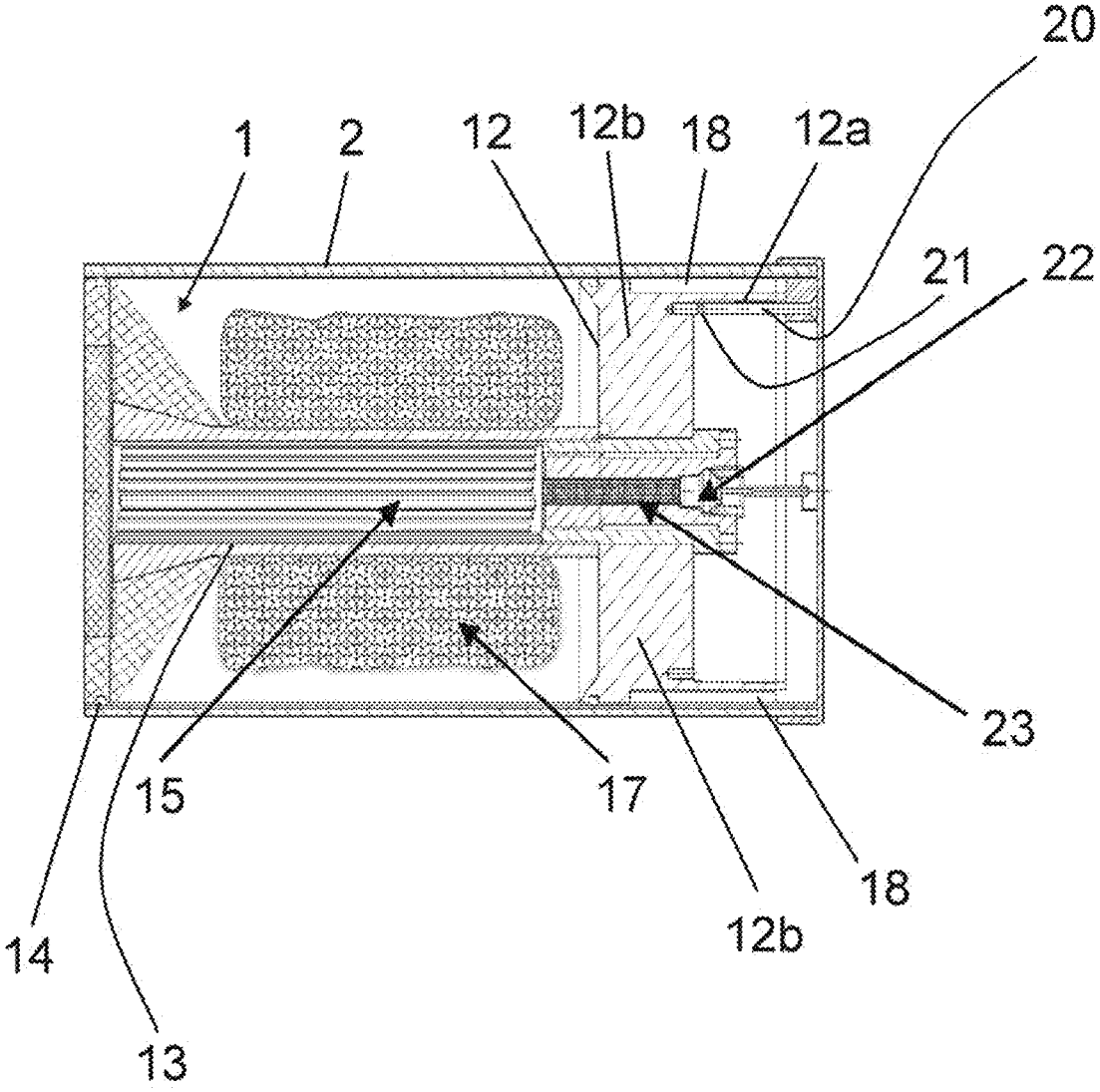
FIG. 2B shows an enlarged illustration of the right-hand (rear) part of the section drawing shown in FIG. 2A.

One preferred embodiment of a grenade firing apparatus according to the invention and one preferred embodiment of the flow cross-section reduction device 12 will be explained in the following text with reference to FIGS. 2A and 2B.

The grenade firing apparatus has a barrel 2 which is open at both ends without any flow cross-section constrictions. A grenade 1 is mounted in the barrel, as is described above and in the following text.

The flow cross-section reduction device 12 is a support for a wire-based data link 18, which can be unwound while the grenade 1 is being fired. This data link 18 connects the grenade 1 to a fire control computer (not illustrated) at least until it leaves the firing barrel 2 or else in the initial flight phase of the grenade 1 after leaving the firing barrel 2. The wire 18 is wound in the form of a coil around the ring 12*a* in a hollow-cylindrical gap, which is open only in the opposite direction to the firing direction X, between the external diameter of the ring 12*a* and the inner surface of the firing barrel 2. In consequence, the wire 18 is affected only to a minimal extent by the hot powder gases and particles which are created when the grenade 1 is fired.

The barrel 2 of the grenade firing apparatus is closed by a cover 19*a*, 19*b* at its front end and rear end for protection against the ingress of foreign particles. The rear cover 19*a* is connected to the grenade 1 via a holding device 20, which is designed to hold the grenade 1 in a rear position in the barrel 2 before firing. The rear cover 19*a* does not represent a ballistic, effective flow cross-section constriction of the firing barrel 2, because it bursts under the initial influence of the gas pressure building up from the main charge 17 of the grenade 1. The rear end of the barrel 2 is therefore opened immediately, without axial forces being introduced into the grenade firing apparatus. The holding device 20 has a weak point 21 where the holding device 20 breaks during acceleration of the grenade 1. The grenade 1 has a firing chain which comprises a propellant charge igniter 22, a relay charge 23, a basic charge 15 and a main charge 17. This is only one of the possible configurations of a firing chain for the grenade according to the invention. However, the firing chain may also have a greater or lesser number of elements. The propellant charge igniter 22 ignites the relay charge 23 (for example 500 mg of potassium nitrate bore). The propellant charge consists of two parts: by way of example, 60 g of Benits powder can be used as the basic charge, and is located in the launch barrel 13. The overflow holes 16 in the launch barrel 13 are sealed by a brass foil. Once the bursting pressure of the brass foil has been reached, the main charge 17 (for example 300 g of Tecna powder) is finally ignited. The gas pressure of the propellant charge 15, 17 bursts the cover 19*a* at the rear, and tears the holding element 20 at its weak point 21. As a consequence of the constriction in the cross section caused by the fin structure cross-sectional area, the gas pressure builds up further, acting on the base of the grenade (that is to say on the rear face of the grenade base body 10), and accelerates it.

According to the invention, a flow cross-section reduction device 12 is provided, which is not firmly connected to the firing barrel 2 but is connected to the grenade base body 10, separated from it, via a connecting device 13, and is connected to it such that it is stable during firing. On the one hand, this ensures that no axial forces are introduced into the grenade firing apparatus when the grenade 1 is fired, while on the other hand the flow cross-section reduction device 12 for reducing the flow cross-section of the barrel 2, which device is arranged in the opposite direction to the firing direction X with respect to the grenade base body 10, advantageously prevents the gas pressure from flowing away too quickly when the grenade 1 is fired.

The invention claimed is:

1. A grenade for recoilless firing from a barrel that is open at both ends and does not have any flow cross-section constrictions, the grenade comprising:

a grenade base body containing therein at least one explosive charge;

a flow cross-section reduction device for reducing a flow cross-section of the barrel, said device being disposed rearward of said grenade base body relative to a firing direction;

a connecting device connecting said flow cross-section reduction device to said grenade base body at a spacing distance therefrom and connecting said flow cross-section reduction device to said grenade base body rigidly stable during firing; and a propellant charge material disposed between said grenade base body and said flow cross-section reduction device, said flow cross-section reduction device preventing a gas pressure created by a burning of said propellant charge material from flowing away too quickly;

wherein said flow cross-section reduction device is a support for a wire-based data link, to be unwound while the grenade is being fired and connecting the grenade to a fire control computer at least until the grenade leaves the firing barrel or during an initial flight phase of the grenade after leaving the firing barrel.

2. The grenade according to claim 1, wherein said grenade base body has a cylindrical shape with an external diameter corresponding substantially to an internal diameter of the firing barrel.

3. The grenade according to claim 2, wherein said grenade base body has sealing means on an envelope surface thereof, and said sealing means are configured for sealing gaps between said envelope surface of said grenade base body and an inner surface of the firing barrel.

4. The grenade according to claim 1, wherein said flow cross-section reduction device comprises a hollow-cylindrical ring connected to said connection device via one or more webs.

5. The grenade according to claim 4, wherein an external diameter of said ring corresponds to an external diameter of said cylindrical grenade base body at least over a portion of a height of said hollow cylinder.

6. The grenade according to claim 4, wherein edges of said webs and/or of said ring are inclined on a side facing said grenade base body.

7. The grenade according to claim 4, wherein walls of said webs and/or of said ring are shaped to render cavities therebetween in the form of nozzles.

8. The grenade according to claim 7, wherein said nozzles have a shape forming a de Laval nozzle.

9. The grenade according to claim 1, wherein said flow cross-section reduction device is an annular fin structure.

10. The grenade according to claim 1, wherein said connection device includes a launch barrel extending on an elongation of a cylindrical longitudinal axis of said grenade base body and contains a basic charge.

11. The grenade according to claim 10, wherein said launch barrel is formed with radial holes allowing an ignited said basic charge to flash over to a main charge arranged in an annular shape around the launch barrel and between said grenade base body and said flow cross-section reduction device.

12. The grenade according to claim 1, wherein said data link includes a wire to be unwound is arranged on said flow cross-section reduction device such that said wire is affected as little as possible by hot powder gases and particles created when the grenade is fired.

13. The grenade according to claim 12, wherein said wire is wound in the form of a coil around said ring in a hollow-cylindrical gap, which is open only in an opposite direction to the firing direction, between an external diameter of the ring and an inner surface of the firing barrel.

14. A grenade firing apparatus, comprising:

a grenade according to claim 1; and a barrel having two open ends and substantially having no flow cross-section constrictions in said barrel.

15. A grenade for recoilless firing from a barrel that is open at both ends and does not have any flow cross-section constrictions, the grenade comprising:

a grenade base body containing therein at least one explosive charge;

a flow cross-section reduction device for reducing a flow cross-section of the barrel, said device being disposed rearward of said grenade base body relative to a firing direction; and a connecting device connecting said flow cross-section reduction device to said grenade base body at a spacing distance therefrom and connecting said flow cross-section reduction device to said grenade base body rigidly stable during firing;

wherein said flow cross-section reduction device is a support for a wire-based data link, to be unwound while the grenade is being fired and connecting the grenade to a fire control computer at least until the grenade leaves the firing barrel or during an initial flight phase of the grenade after leaving the firing barrel.

16. The grenade according to claim 15, wherein said data link includes a wire to be unwound is arranged on said flow cross-section reduction device such that said wire is affected as little as possible by hot powder gases and particles created when the grenade is fired.

17. The grenade according to claim 16, wherein said wire is wound in the form of a coil around said ring in a hollow-cylindrical gap, which is open only in an opposite direction to the firing direction, between an external diameter of the ring and an inner surface of the firing barrel.

18. A grenade for recoilless firing from a barrel that is open at both ends and does not have any flow cross-section constrictions, the grenade comprising:

a grenade base body containing therein at least one explosive charge;

a flow cross-section reduction device for reducing a flow cross-section of the barrel, said device being disposed rearward of said grenade base body relative to a firing direction;

a connecting device connecting said flow cross-section reduction device to said grenade base body at a spacing distance therefrom and connecting said flow cross-section reduction device to said grenade base body rigidly stable during firing;

a propellant charge material disposed between said grenade base body and said flow cross-section reduction device, said flow cross-section reduction device preventing a gas pressure created by a burning of said propellant charge material from flowing away too quickly;

wherein said flow cross-section reduction device comprises a hollow-cylindrical ring connected to said connection device via one or more webs, with walls of said webs and/or of said ring being shaped to render cavities therebetween in the form of nozzles being shaped as a de Laval nozzle.

* * * * *